United States Patent [19]

Sharp

[11] Patent Number: 4,727,992

[45] Date of Patent: Mar. 1, 1988

[54] DISPLAY STANDS

[75] Inventor: John M. Sharp, Leicester, United Kingdom

[73] Assignee: Carter Design Group, Ltd., Foxton, England

[21] Appl. No.: 13,945

[22] Filed: Feb. 12, 1987

[30] Foreign Application Priority Data

Mar. 21, 1986 [GB] United Kingdom ..... 8607115

[51] Int. Cl.[4] ..... A47F 7/00

[52] U.S. Cl. ..... 211/13; 211/4; 248/551

[58] Field of Search ..... 248/551, 552, 553; 211/13, 124, 205, 4, 7; 206/566, 565; 70/62

[56] References Cited

U.S. PATENT DOCUMENTS

| | | | |
|---|---|---|---|
| 3,570,676 | 3/1971 | Crosslen | 70/62 X |
| 3,674,156 | 7/1972 | Krebs | 211/4 |
| 3,805,962 | 4/1974 | Bendiksen | 211/4 |
| 4,300,690 | 11/1981 | Thomas | 211/124 X |
| 4,420,084 | 12/1983 | Whelan | 211/13 X |
| 4,629,263 | 12/1986 | Hendricks | 211/4 X |

*Primary Examiner*—Ramon O. Ramirez
*Attorney, Agent, or Firm*—Charles W. Helzer

[57] ABSTRACT

A display stand comprises an upright member (10), a number of fixed arms (12) projecting forward and provided with article support means (14). A bar (16) is movable in relation to each arm (12) from a first position in which the bar (16) renders it impossible to remove an article from the support means to a second position in which an article can be removed. Locking means (18) are provided for locking the bar (16) in the first position. The stand is suitable for personal adornments, chains, bangles and watches at point of sale.

16 Claims, 9 Drawing Figures

DISPLAY STANDS

DESCRIPTION

1. Technical Field

The invention relates to display stands suitable for personal adornments, chains, bangles and watches at point of sale.

2. Background Art

One of the problems with point of sale display is security: to allow the customer to handle the goods but not to steal them.

THE INVENTION

The invention provides a display stand which comprises an upright member, a number of fixed arms projecting forward from the upright member and provided with article support means, a bar movable in relation to each arm from a first position in which the bar renders it impossible to remove an article from the support means to a second position in which an article can be removed, and means for locking the bar in the first position.

Each arm is preferably provided with a fixed cross member having article support means, and the bar with a corresponding cross member. The article support means should be provided with a projection or projections to prevent an article being slid off the end. The bar cross member is preferably provided with flanges movable adjacent the ends of the article support means to help prevent an article being slid off the end. The means for locking is preferably on a flange projecting from the bar and engageable with the upright member.

The article support means preferably comprises a curved surface suitable for receiving a bangle, and/or may be provided with a number of upright pins approaching close to the bar for passing through a link in a chain, or a buckle or ring so as to help in preventing removal of the article.

An article can be removed for sale by a shop assistant unlocking the bar, and moving it to its second position. The article support means may be loaded with articles when the bar is in its second position, and the articles secured by moving the bar to its first position and locking.

DRAWINGS

BEST MODE

Figure 1:
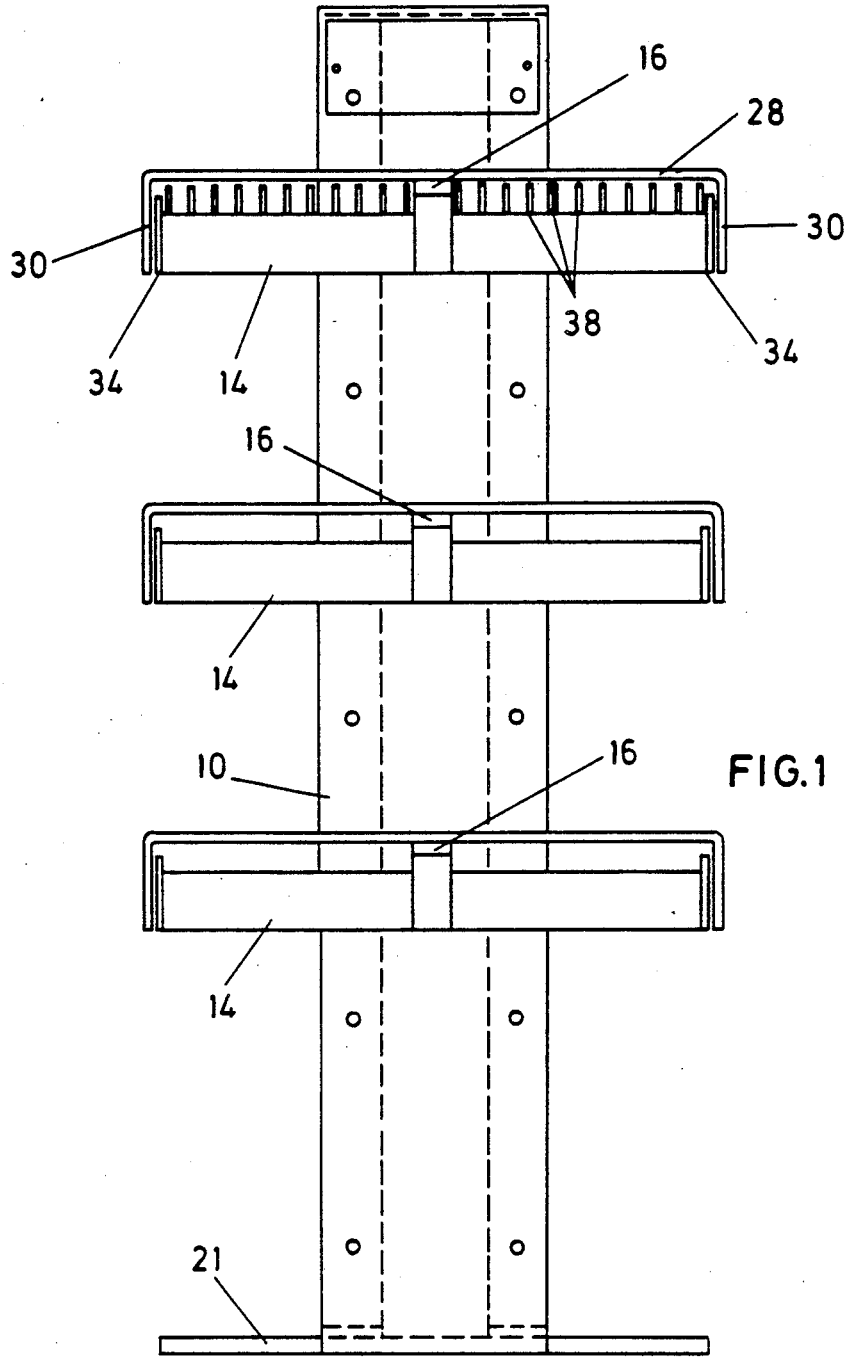
FIG. 1 is a front elevation of a display stand according to the invention.

In the drawings, the display stand comprises an upright member 10, three fixed arms 12 projecting forward from the upright 10 and provided with article support means 14, a bar 16 movable in relation to each arm 12, and means 18 for locking each bar 12 is relation to the upright 10.

Figure 2:
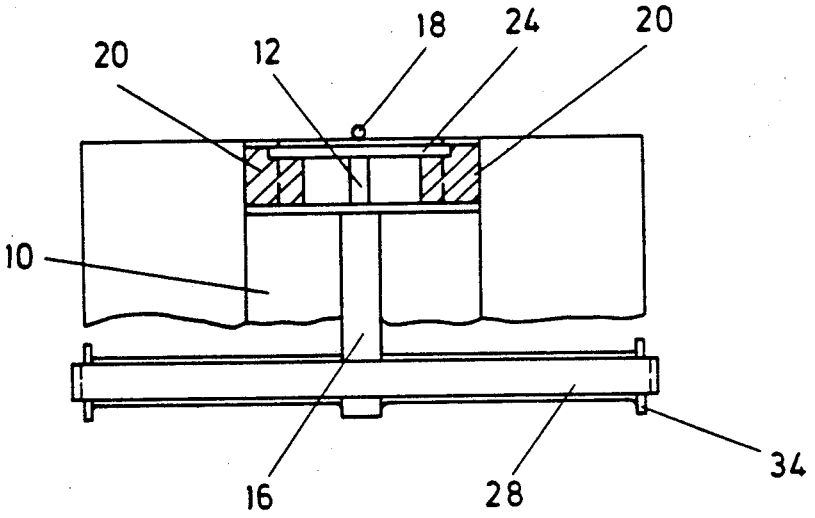
FIG. 2 is a plan corresponding to FIG. 1 showing the locking mechanism.

As best shown in FIG. 2, the upright 10 comprises two posts 20 secured to a base 21 and bearing fabric-covered panels 22 (FIG. 3) front and back. Three cross pieces 24 (FIG. 2) are screwed at one end to each of the posts 20, and having one of the arms 12 welded thereto and projecting forward therefrom.

The arms 12 each have a cross member fixed at the outer end bearing curved article support means 14 consisting of a plastics injection moulding. The arms 12 themselves are similarly covered, having a plastics injection moulding secured thereto by a bolt 26 (FIG. 3).

Figure 3:
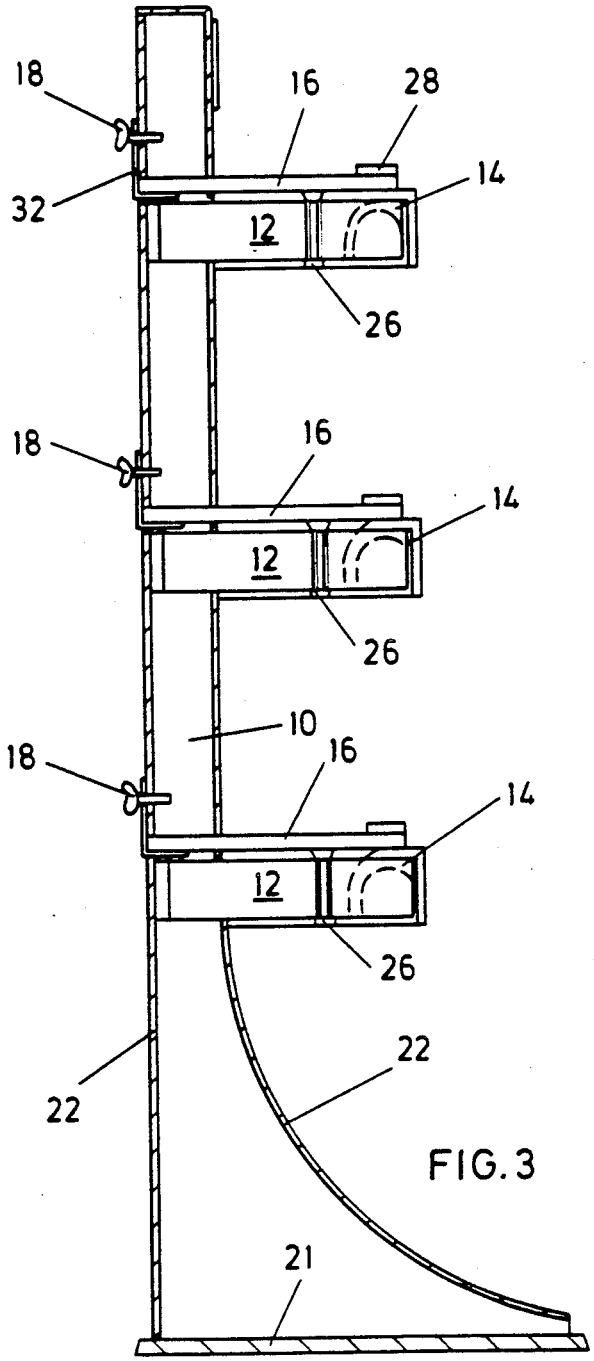
FIG. 3 is a central section normal to FIG. 1.

The details of the bars 16 are best seen in FIG. 3 where they have been indicated only adjacent the uppermost arm 12. The bar 16 has a fixed cross member 28 with flanges 30 projecting downward adjacent the ends of the article support means 14 to help prevent an aricle being slid off the end. At the other end, the bar 16 is provided with an upward-projecting flange 32 to the rear of the upright 10. The flange 32 is provided with a hole through which the locking means 18 or catch projects into the back of the upright 10, and can be used to secure the bar 16 in its first or locked position so as to engage with the upright 10.

The article support means 14 are each provided with a projection 34 at each end to prevent an article being slid off and removed. The uppermost article support means 14 is provided with a number of upright pins 38 approaching close to the cross member 28 of the bar 16 for passing through a link in a chain, for example, so as to help in preventing its removal. The lower two article support means 14 have no pins 38, but are suitable for displaying a bangle, for example.

All the bars 16 in the drawings are shown in their first position in which they render it impossible to remove an article from the support means 14. It can readily be seen that an annular article passing between the support means 14 and the bar 16 can only be removed by breaking the article. By unlocking the catch 18 from the upright 10, the bar 16 can be slid to the left (FIG. 3), and thus separated by a short distance from the article support means 14. In this second position of the bar 16, an annular article can be loaded onto the article support means 14 or removed therefrom by lifting over either of the ends of the support means 14. The bar 16 can then be slid back rightward to the first or locking position shown in the drawings.

Figure 4:
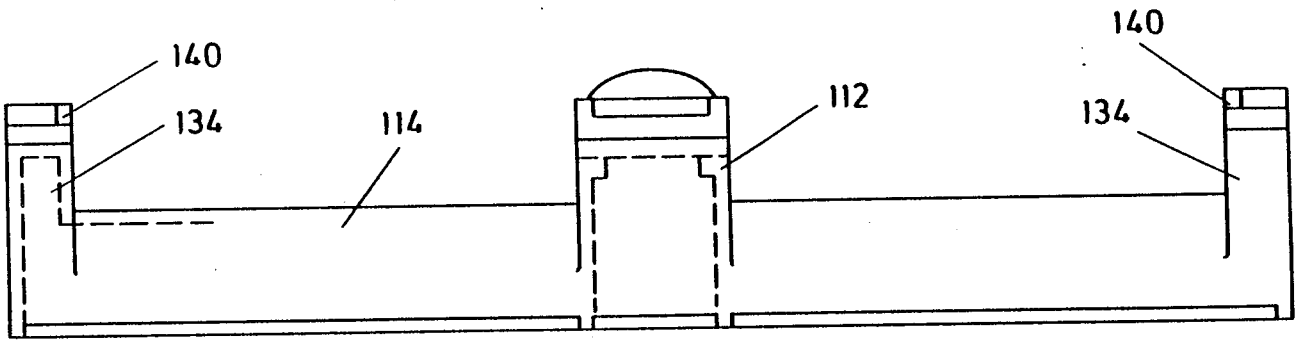
FIG. 4 is a front elevation of a modified arm for a stand according to the invention.
Figure 5:
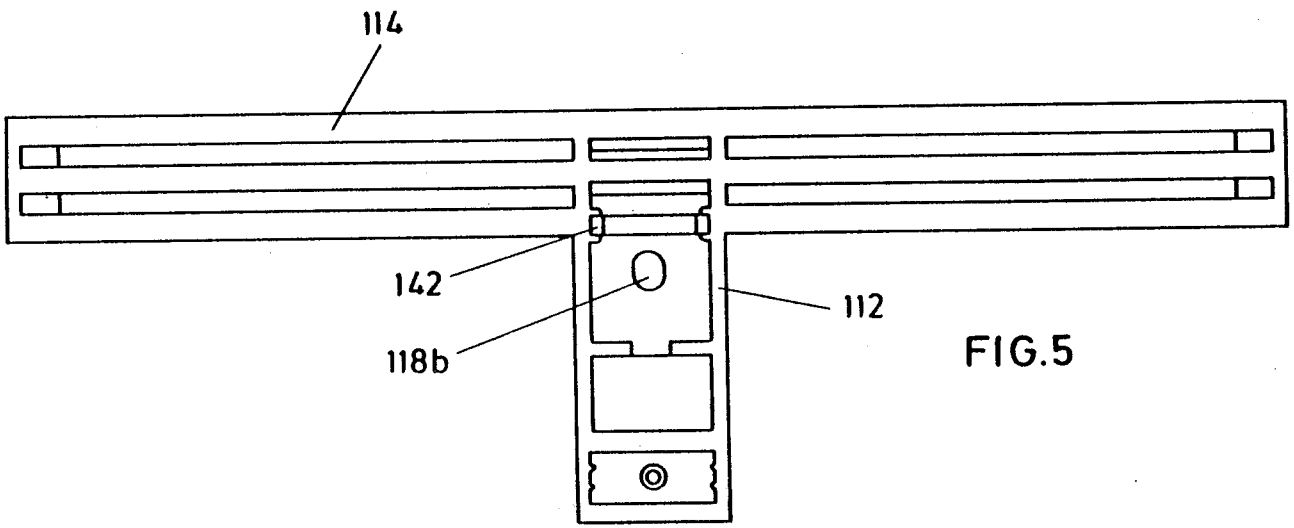
FIG. 5 is a view from beneath corresponding to FIG. 4.
Figure 6:
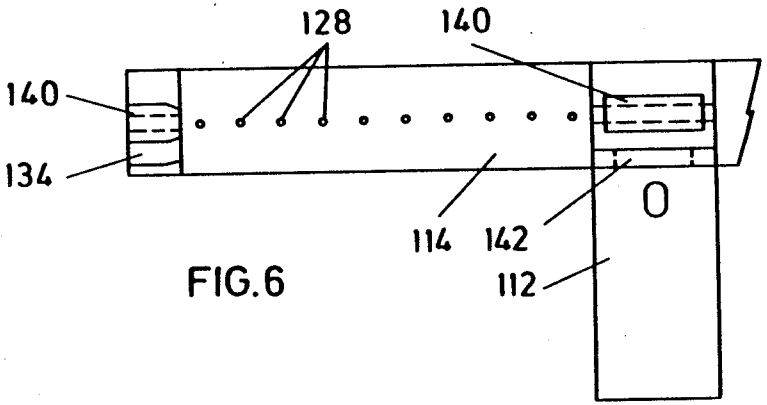
FIG. 6 is a top plan corresponding to one side only of FIG. 4, showing the use of pins for separating articles.
Figure 7:
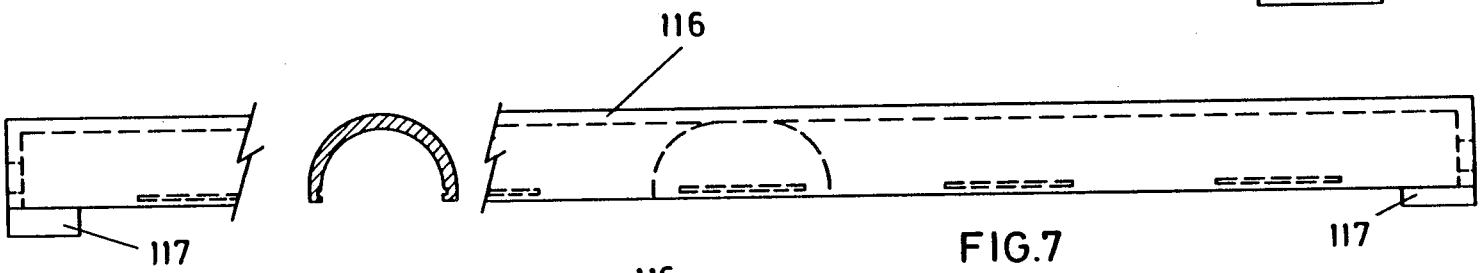
FIG. 7 is a front elevation and part-section of a bar for cooperating with the arm of FIGS. 4 to 6.
Figure 8:
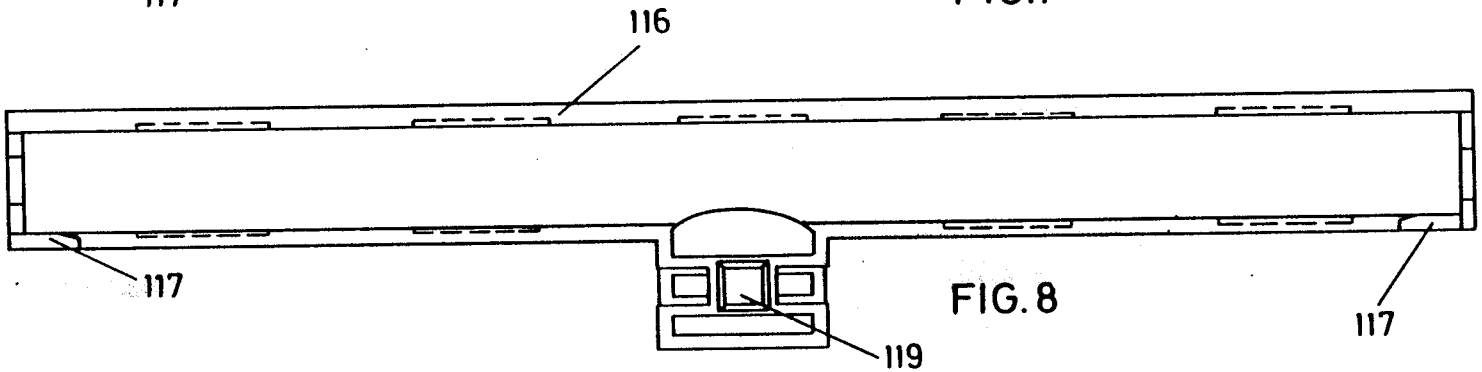
FIG. 8 is a view from beneath FIG. 7.

A modified arm 112 of FIGS. 4 to 6 consists of plastics injection mouldings adhering together to form a unit having a cross member with a curved article support means 114. The means 114 are provided with a projection 134 at each end to prevent an article being slid off. The side shown in FIG. 6 is provided with optional pins 128 to separate articles and help in preventing removal. The projections 134 and the arm 112 have at the top a flange 140 with lateral projections along which a bar 116 (FIGS. 7 and 8) can be slid to left or right. A stop 142 on the arm 112 with projections 117 to prevent removal of the arm 116.

Figure 9:
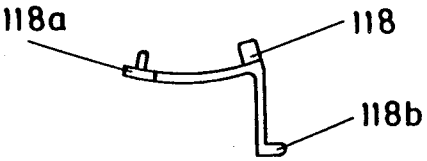
FIG. 9 is a side view of locking means in the arm of FIGS. 4 to 6.

Locking means 118 secures the arm 116 in a (first) position directly of the article support means 114 so that an article cannot be removed. The locking means 118 comprises a catch receivable in a recess 119 in the lower side of the bar 116 for locking the bar 116 in the first position. The locking means 118 consists of an L-shaped piece of plastics material (see FIG. 9) with the catch at the central or angled portion, secured at one end 118*a* to the inside of the bar 112, and having at the other end 118*b* a release member visible in FIG. 5. Finger pressure on the release member flexes the locking means 118, withdraws the catch, and releases the bar 116 for sliding movement to left or right.

I claim:

1. A display stand suitable for personal adornments, chains, bangles and watches at point of sale characterized by an upright member, a number of fixed arms projecting forward from the upright member and provided with article support means, a bar movable in relation to each arm from a first position in which the bar renders it impossible to remove an article from the support means to a second position in which an article can be removed, and means for locking the bar in the first position, each arm being provided with a fixed bar cross member having the article support means, and the bar with a corresponding cross member.

2. A display stand according to claim 1 in which the article support means is provided with a projection or projections to prevent an article being slid off the end.

3. A display stand according to claim 1 in which bar cross member is provided with flanges movable adjacent the ends of the article support means to help prevent an article being slid off.

4. A display stand according to claim 1 in which the means for locking is on a flange projecting from the bar and engageable with the upright member.

5. A display stand according to claim 1 in which the article support means comprises a curved surface suitable for receiving a bangle.

6. A display stand according to claim 5 in which the article support means is provided with a number of upright pins approaching close to the bar for passing through a link in a chain, or a buckle or ring to help in preventing removal of the article.

7. A display stand according to claim 5 in which the bar is slidable along the arm.

8. A display stand suitable for personal adornments, chains, bangles and watches at point of sale characterized by an upright member, a number of fixed arms projecting forward from the upright member and provided with article support means, a bar movable in relation to each arm from a first position in which the bar renders it impossible to remove an article from the support means to a second position in which an article can be removed, and means for locking the bar in the first position, and in which a bar cross member is provided with flanges movable adjacent the ends of the article support means to help prevent an article being slid off.

9. A display stand according to claim 4 in which the means for locking is on a flange projecting from the bar and engageable with the upright member.

10. A display stand according to claim 8 in which the article support means comprises a curved surface suitable for receiving a bangle.

11. A display stand according to claim 8 in which the article support means is provided with a number of upright pins approaching close to the bar for passing through a link in a chain, or a buckle or ring to help in preventing removal of the article.

12. A display stand suitable for personal adornments, chains, bangles and watches at point of sale characterized by an upright member, a number of fixed arms projecting forward from the upright member and provided with article support means, a bar movable in relation to each arm from a first position in which the bar renders it impossible to remove an article from the support means to a second position in which an article can be removed, and means for locking the bar in the first position, and wherein the means for locking is on a flange projecting from the bar and engageable with the upright member.

13. A display stand according to claim 12 in which the article support means comprises a curved surface suitable for receiving a bangle.

14. A display stand according to claim 12 in which the article support means is provided with a number of upright pins approaching close to the bar for passing through a link in a chain, or a buckle or ring to help in preventing removal of the article.

15. A display stand suitable for personal adornments, chains, bangles and watches at point of sale characterized by an upright member, a number of fixed arms projecting forward from the upright member and provided with article support means, a bar movable in relation to each arm from a first position in which the bar renders it impossible to remove an article from the support means to a second position in which an article can be removed, and means for locking the bar in the first position in which the article support means is provided with a projection or projections to prevent an article being slid off the end, and in which bar cross member is provided with flanges movable adjacent the ends of the article support means to help prevent an article being slid off.

16. A display stand suitable for personal adornments, chains, bangles and watches at point of sale characterized by an upright member, a number of fixed arms projecting forward from the upright member and provided with article support means, a bar movable in relation to each arm from a first position in which the bar renders it impossible to remove an article from the support means to a second position in which an article can be removed, and means for locking the bar in the first position in which the article support means is provided with a projection or projections to prevent an article being slid off the end, and in which the means for locking is on a flange projecting from the bar and engageable with the upright member.

* * * * *